US006536886B1

(12) United States Patent
Mott

(10) Patent No.: US 6,536,886 B1
(45) Date of Patent: Mar. 25, 2003

(54) RESERVOIR INTEGRATION FOR MULTI-PART INKJET PRINTING SYSTEM, AND METHOD

(75) Inventor: James A. Mott, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 10/000,250

(22) Filed: Oct. 29, 2001

(51) Int. Cl.[7] ..... B41J 2/175; B41J 2/21
(52) U.S. Cl. ..... 347/85; 347/96
(58) Field of Search ..... 347/85, 86, 7, 347/21, 95, 96, 98, 102; 354/298; 399/54; 101/483

(56) References Cited

U.S. PATENT DOCUMENTS 5,446,516 A * 8/1995 Burbury et al. ..... 354/298
5,635,969 A * 6/1997 Allen ..... 347/96
5,644,350 A 7/1997 Ando et al. ..... 347/101
5,860,363 A * 1/1999 Childers et al. ..... 101/483
5,897,239 A * 4/1999 Caruthers, Jr. et al. ..... 399/54
6,261,350 B1 7/2001 Kabalnov ..... 106/31.33
6,293,668 B1 9/2001 Kubby et al. ..... 347/101

* cited by examiner

*Primary Examiner*—Anh T. N. Vo
(74) *Attorney, Agent, or Firm*—Larry D. Baker

(57) ABSTRACT

Embodiments of the present invention comprise a reservoir system for supplemental fluids in a system (such as an inkjet printer) in which supplies of a supplemental fluid are included in two or more replaceable primary fluid containers (such as ink containers). A controller may then selectively connect a supply of the supplemental fluid to the device utilizing the supplemental fluid (such as a fixer applicator). The present invention allows the use of supplemental fluid such as a fixer in an inkjet printer, giving all of the print quality durability, and throughput (drytime) advantages of a two-part system, without the printer user being aware that the printing system requires this additional consumable.

29 Claims, 5 Drawing Sheets

RESERVOIR INTEGRATION FOR MULTI-PART INKJET PRINTING SYSTEM, AND METHOD

FIELD OF THE INVENTION

This invention relates to inkjet printers having an auxiliary coating apparatus for applying a supplemental fluid to print media, and apparatus and methods of supplying the fluid.

BACKGROUND OF THE INVENTION

Inkjet printers typically use a printhead mounted on a carriage that is moved relative to a print media, such as paper. As the printhead is moved relative to the print media, a control system activates the printhead to deposit or eject ink droplets onto the print media to form images and text. Ink is provided to the printhead by a supply of ink that is either integral with the printhead, as in the case of a disposable print cartridge, or by a supply of ink that is replaceable separate from the printhead. With separately replaceable ink supplies, the ink supply is replaced when exhausted, and the printhead is then replaced at the end of the printhead useful life.

Inkjet printers have typically had several shortcomings. First, image quality is dependent upon the print media. Optical density of a printed image can vary greatly with the print media or substrate being printed upon. Images may have poor edge acuity, color-to-color bleed, and low chroma, as well as low waterfastness and a tendency to smudge. Second, ink drying time can be a significant factor in limiting printer throughput.

Techniques to address these shortcomings often involve the application of a supplemental fluid to the print media, either before printing or after printing. In underprinting, a transparent fluid is applied to the substrate prior to ink deposition, which helps to stratify the colorant to the surface of the paper, reduces wicking, and improves color performance.

Two-part inkjet printing is composed of a printing ink and a substance commonly referred to as a "fixer". Typically, fixer is applied to the media via an additional printhead or other applicator mechanism prior to printing the ink. The ink reacts with the fixer upon contact on the media surface, immobilizing the ink colorant close to the media surface. This technique provides a more consistent dot shape across media types, faster dry times, and better durability, among other advantages.

The principle disadvantage of using a fixer or other supplemental fluid, from the perspective of the printer operator, is the need to provision the printer system with an additional consumable. In a typical prior art multi-part printing system, the printer operator must monitor and replace not only the ink supplies, but also a separate fixer supply.

Accordingly, there is a need for apparatus and methods which enable multi-part printing, without the disadvantages imposed by an additional printer consumable.

SUMMARY OF THE INVENTION

Embodiments of the present invention comprise a reservoir system for supplemental fluids in a system (such as an inkjet printer), in which supplies of a supplemental fluid are included in two or more replaceable primary fluid containers (such as ink containers). A controller may then selectively connect a supply of the supplemental fluid to the device utilizing the supplemental fluid (such as a fixer applicator).

Among other advantages, the present invention allows the use of fixer in an inkjet printer, giving all of the print quality, durability, and throughput (drytime) advantages of a two-part system, without the printer user ever knowing that the printing system requires this additional consumable. By maintaining the number of consumables in the inkjet printing system to the total number of inks, the printer user is not required to locate, purchase, and replace additional consumables during the lifetime of the printer. The present invention thus provides the benefits of using a fixer or other supplemental fluid in an inkjet printing system without increasing the user intervention rate.

Other aspects and advantages of the present invention will become apparent from the following detailed description, taken in conjunction with the accompanying drawings, illustrating by way of example the principles of the invention.

DETAILED DESCRIPTION OF THE PREFERRED EMBODIMENT

Figure 1:
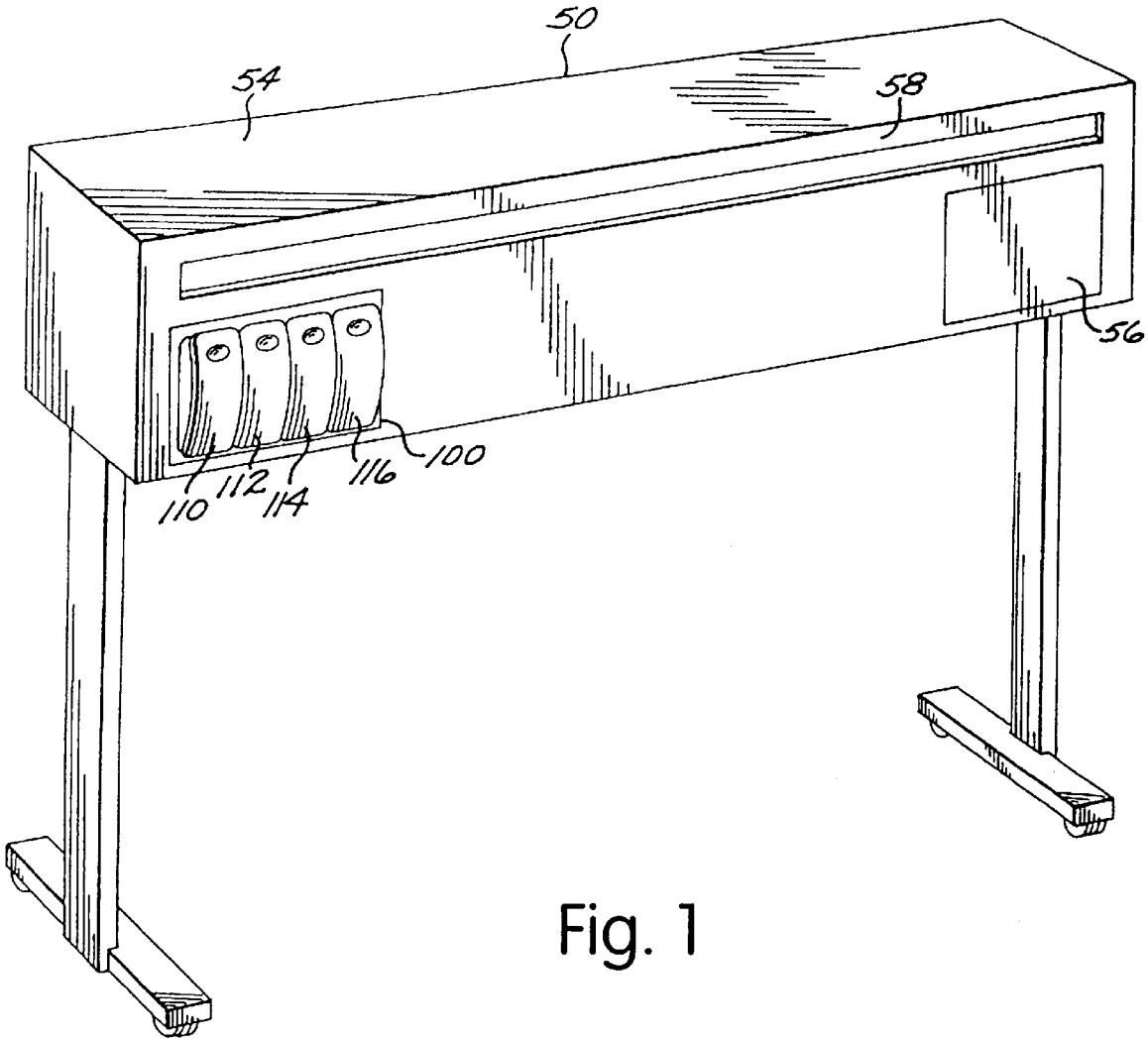
FIG. 1 is one exemplary embodiment of an inkjet printing system in which the integrated reservoirs of the present invention may be utilized.

FIG. 1 shows in isometric view an exemplary form of a printer/plotter system 50, wherein four off-carriage ink containers 110, 112, 114, 116 are shown in place in the ink supply station. Although FIG. 1 depicts a "large format" printer system for printing on wide media, the present invention is also applicable to smaller printers, such as those intended for printing photographic images. The system includes a housing 54, a front control panel 56 which provides user control switches, and a media output slot 58 through which the media is output from the system after the printing operation. This exemplary system is fed from a media roll; alternatively sheet fed systems are also well known in the art.

The exemplary inkjet printer of FIG. 1 may be adapted to apply a fixer or other supplemental fluid to the print media. Typically, as discussed below, an additional container for the fluid used (not shown in FIG. 1). The additional container then requires additional attention from the printer user. Ideally, the use of a fixer or other supplemental fluid would require no additional intervention on the part of the printer user.

Figure 2:
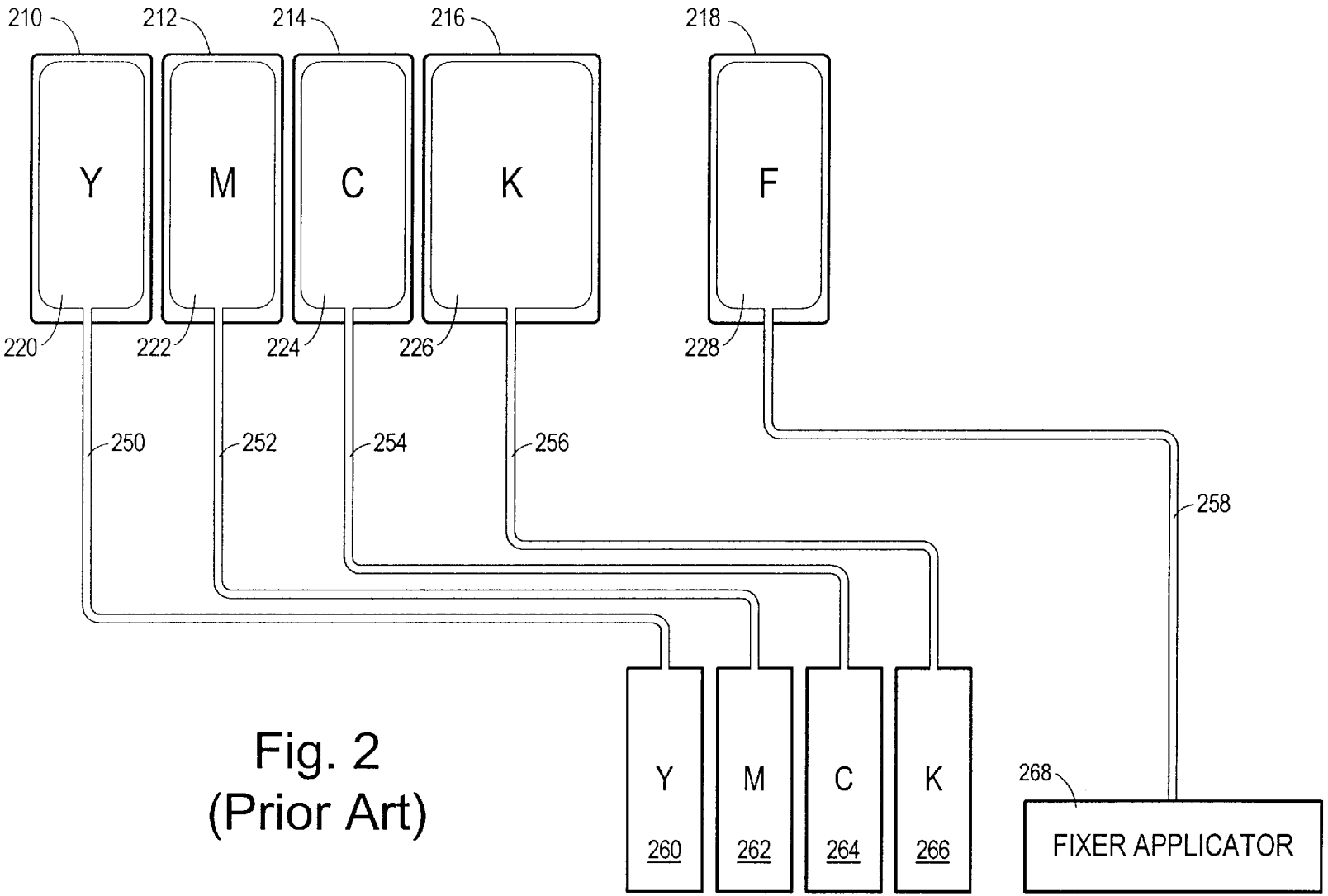
Fig. 2 (Prior Art)
FIG. 2 is a simplified schematic representation of the exemplary prior art inkjet printing system having a separate reservoir for a fixer fluid.

FIG. 2 is a simplified schematic representation of an exemplary prior art inkjet printing system having a separate reservoir for a supplemental fluid. The exemplary printing system includes separate ink containers for each of three primary colors (yellow 210, magenta 212, and cyan 214) and black 216. Each of the separate ink containers holds a supply 220, 222, 224, 226 of the respective ink. Each supply is fluidically coupled 250, 252, 254, 256 to a printhead 260. 262, 264, 266 for the respective color of ink.

In the exemplary prior art inkjet printer of FIG. 2, the fixer or supplemental fluid is provided in a separate fluid container 218. The supply of fluid 228 within the container is fluidically coupled 258 to a device which utilizes the supplemental fluid, such as a fixer applicator 268. The applicator 268 may be an additional (long-life) printhead mounted on the carriage alongside the ink printheads, or it may be roller or sponge mechanism, or any other mechanism as is known in the art. To make use of the fixer applicator, the printer user must ensure that an adequate supply of fixer is present, and thus, in the printer system of FIG. 2, must acquire, monitor, and replace the additional fixer consumable throughout the life of the printer system.

Figure 3:
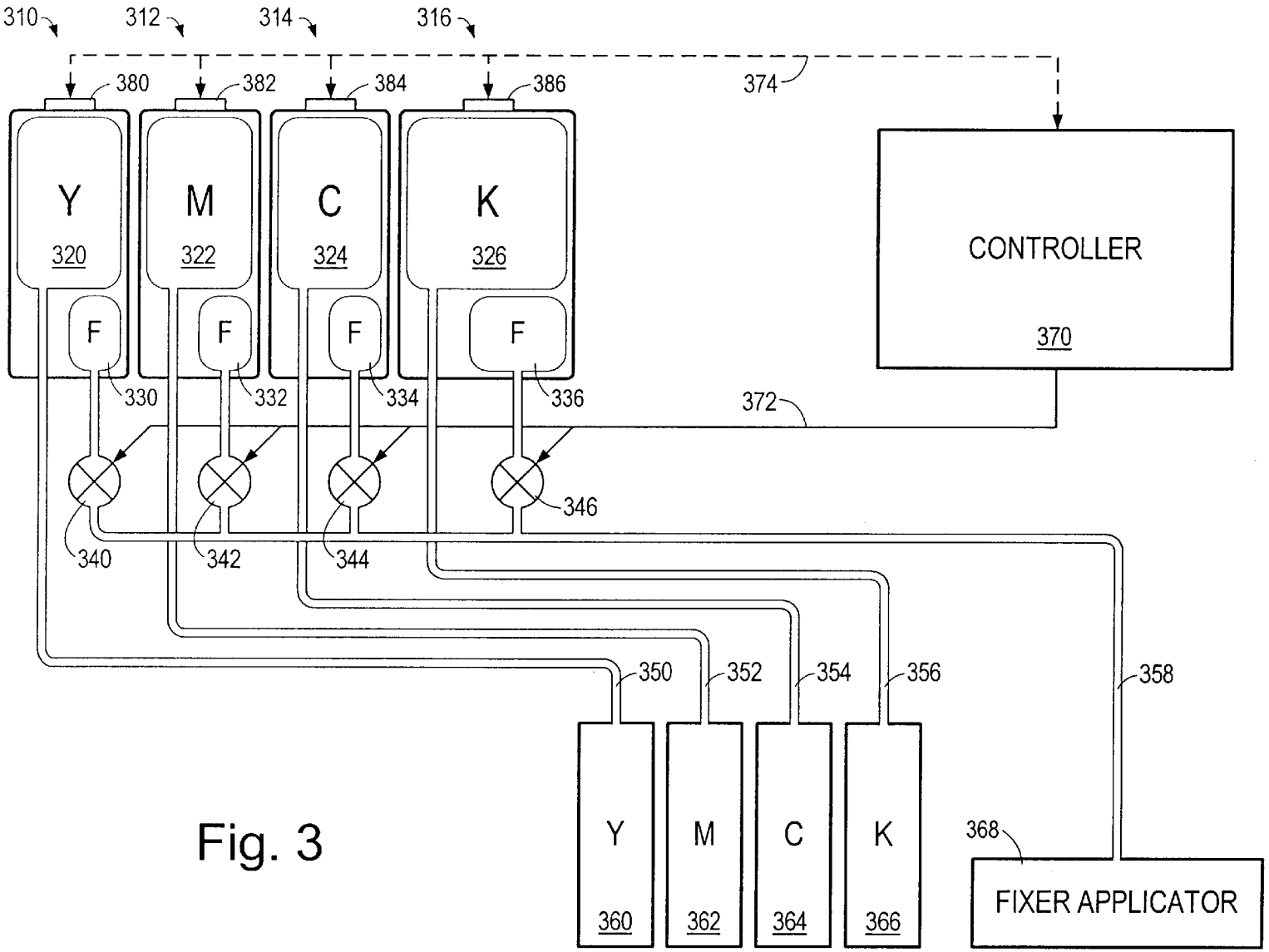
FIG. 3 is a simplified schematic representation of an exemplary inkjet printing system incorporating the integrated reservoir system of the present invention.

FIG. 3 is a schematic representation of an exemplary inkjet printing system incorporating the reservoir integration for multi-part inkjet printing the present invention. In the exemplary embodiment, four ink containers 310, 312, 314, 316 are shown containing yellow, magenta, cyan, and black ink, respectively. These containers may be mounted remotely from the printheads (an "off-axis" printer), or the ink containers may be mounted on the printer carriage with the printheads. Each of the containers includes a supply of ink 320, 322, 324, 326, and also includes a separate supply of fixer 330, 332, 334, 336, or some other fluid utilized by the printing system. Alternatively, supplies of the supplemental may be included in a smaller number of the containers, such as a supply of fixer in a "black" container, and a supply of fixer in a combined "color" container. Each of the supplies of fixer is fluidically coupled to a valve 340, 342, 344, 346, which allows any of the separate supplies of fixer to be fluidically coupled to the fixer applicator 368.

When maintaining the printer, the user would locate, purchase, and replace a reservoir for each ink in the printing system as required, but need not be aware that an appropriate amount of fixer is included in each reservoir. Thus, printer maintenance would be the same as for a printer without the added capability afforded by a multi-part printing system.

The valves 340, 342, 344, 346 are selectively activated by a controller 370 using control signals 372. The controller is preferably integrated with the electronic controller which monitors and controls other printer functions. The valves may be placed at any convenient location in the fluid delivery path, such as in a fluid manifold which interfaces with the ink containers (not shown in FIG. 3). Alternatively, the valves may be integral within the ink containers themselves.

The controller 370 may also communicate with electronic memory devices 380, 382, 384, 386 affixed to the ink containers 310, 312, 314, 316 over communication lines 374. The electronic memory devices, as is well known in the art, may include information on remaining ink and ink usage, allowing the controller to determine the relative amounts of ink remaining in each of the containers. The memory devices may also include information indicating the presence of a fixer supply within the consumable, and information tracking the amount of fixer remaining in the supply.

Figure 4:
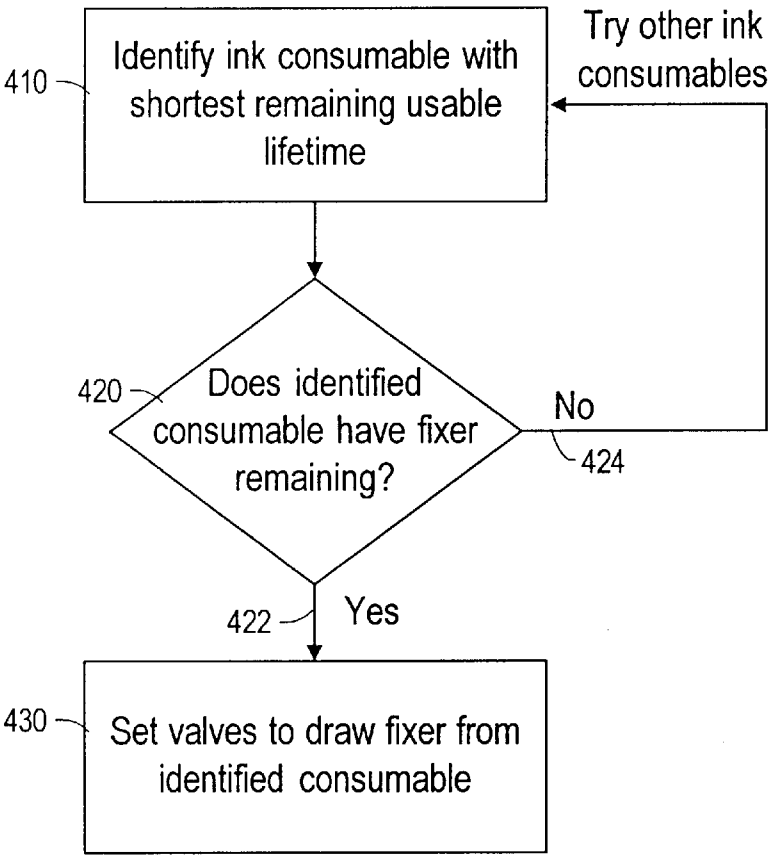
FIG. 4 is a flow diagram of an exemplary embodiment of the present invention, illustrating how the printer controller determines from which fluid supply fluid is to be drawn.

FIG. 4 is a flow diagram of one embodiment of the present invention, illustrating how the controller determines which container to draw supplemental fluid from. In the embodiment of FIG. 4, the printer controller monitors the ink and fixer levels of each ink reservoir. The controller first identifies 410 the ink consumable with the shortest remaining usable lifetime. The controller verifies 420 that the identified consumable has fixer fluid remaining, and, if it does 422, the controller sets the valves 430 to selectively use fixer from the identified consumable. If the identified consumable does not have supplemental fluid remaining 424, the controller identifies the consumable with the next shortest remaining lifetime, repeating the loop until a consumable with fixer is found.

The embodiment of FIG. 4 ensures that sufficient fixer remains in the system even after an empty ink reservoir is replaced with a new one. When a new reservoir with a fresh supply of ink and fixer is loaded, the printer would switch to using fixer from the reservoir with the next lowest ink level.

Figure 5:
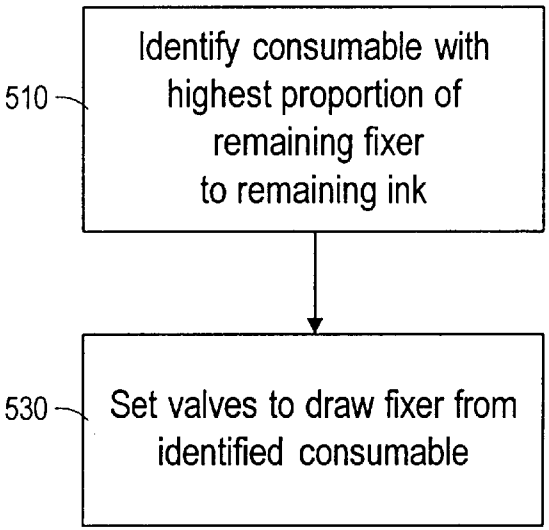
FIG. 5 is a flow diagram of an alternate embodiment of the present invention, illustrating how the printer controller determines from which fluid supply fluid is to be drawn.

In the alternate embodiment of FIG. 5, the printer controller balances the amount of fixer used from each reservoir based on the amount of ink consumed from each reservoir. At 510, the controller determines which consumable has the highest proportion of remaining fixer to remaining ink, and then sets the valves 530 to selectively use fixer from the identified consumable. Other schemes to maximize the efficient usage of the fixer supplies in addition to those depicted in FIG. 4 and FIG. 5 may be easily devised to one skilled in the art.

Figure 6:
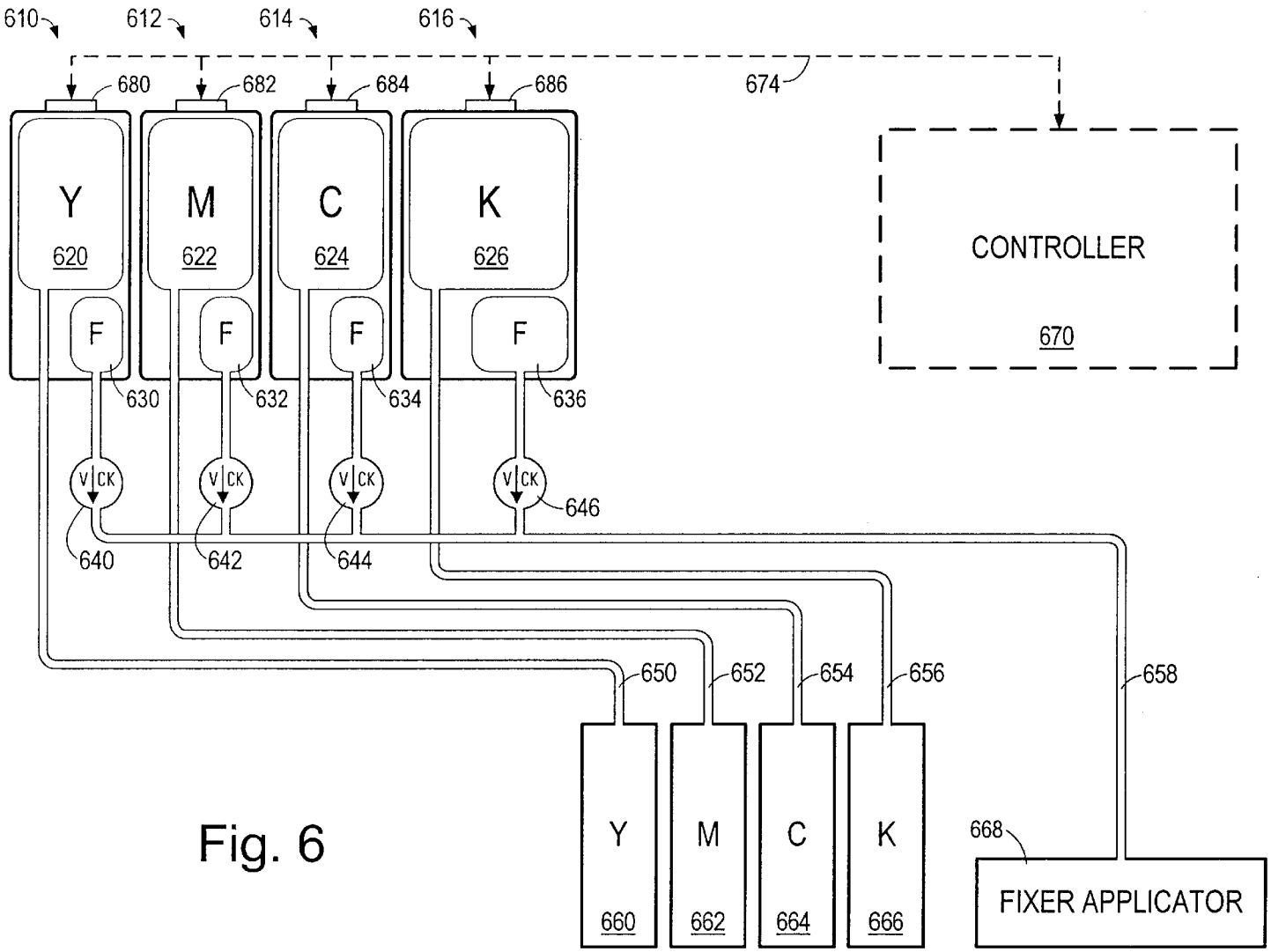
FIG. 6 is a simplified schematic representation of an exemplary inkjet printing system incorporating a further alternate embodiment of the integrated reservoir system of the present invention.

FIG. 6 is a schematic representation of an exemplary inkjet printing system incorporating a further alternate embodiment of the present invention. The further alternate embodiment utilizes check valves 640, 642, 644, 646 in each of the supplemental fluid lines, rather than valves under control by the controller. In the further exemplary embodiment, four ink containers 610, 612, 614, 616 are shown containing yellow, magenta, cyan, and black ink, respectively. Each of the containers includes a supply of ink 620, 622, 624, 626, and also includes a separate supply of fixer 630, 632, 634, 636, or some other fluid utilized by the printing system. Alternatively, supplies of the supplemental may be included in a smaller number of the containers, such as a supply of fixer in a "black" container, and a supply of fixer in a combined "color" container.

Each of the supplies of fixer 630, 632, 634, 636 is fluidically coupled to a check valve 640, 642, 644, 646. The output of each check valve is in turn fluidically coupled to the fixer applicator 668. Thus, in the further alternate embodiment, fixer may be drawn from any of the containers, without intervention by the controller 670. While not providing as efficient usage of fixer as the other embodiments discussed above (more unused fixer may potentially be discarded when ink containers are replaced), the further alternate embodiment of FIG. 6 allows for a potentially less expensive printer system.

The check valves, like the valves of the embodiments discussed above, may be placed at any convenient location in the fluid delivery path, such as in a fluid manifold which interfaces with the ink containers (not shown in FIG. 6). Alternatively, the check valves may be integral within the ink containers themselves. The further alternate embodiment may include a controller 670 to monitor and control other printer functions, such as communicating with electronic memory devices 680, 682, 684, 686 over communication lines 674. The electronic memory devices may include information on remaining ink and ink usage, allowing the controller to determine the relative amounts of ink remaining in each of the containers. The memory devices may also include information indicating the presence of a fixer supply within the consumable, and information tracking the amount of fixer remaining in the supply.

While described with respect to an exemplary inkjet container and printer system, the present invention is not limited to inkjet applications, and may be effectively utilized in other applications where it is important to provide a supplemental fluid for use in a system without adding the additional user intervention requirements that a separate replaceable consumable supply entails.

The above is a detailed description of particular embodiments of the invention. It is recognized that departures from the disclosed embodiments may be within the scope of this invention and that obvious modifications will occur to a person skilled in the art. It is the intent of the applicant that the invention include alternative implementations known in the art that perform the same functions as those disclosed. This specification should not be construed to unduly narrow the full scope of protection to which the invention is entitled.

What is claimed is:

1. A system having a plurality of replaceable primary fluid containers and a device requiring a supplemental fluid, apparatus for supplying the supplemental fluid, comprising:

within at least two of the replaceable primary fluid containers, a supply of the supplemental fluid; and a valve mechanism in fluid communication with each of the supplies of supplemental fluid, and in fluid communication with the device requiring the supplemental fluid.

2. The system of claim 1, wherein the system is a printer and the primary fluid containers are ink containers.

3. The system of claim 2, wherein the supplemental fluid comprises a fixer chemical and the device requiring a supplemental fluid is a fixer applicator.

4. The system of claim 1, further comprising a controller for selectively fluidically coupling at least one of the supplies of supplemental fluid to the device requiring the supplemental fluid through the valve mechanism.

5. The system of claim 1, wherein the valve mechanism further comprises check valves in fluid communication with each of the supplies of supplemental fluid, and in fluid communication with the device requiring the supplemental fluid.

6. A system having a plurality of replaceable primary fluid containers and a device requiring a supplemental fluid, apparatus for supplying the supplemental fluid, comprising:

within at least two of the replaceable primary fluid containers, a supply of the supplemental fluid;

a valve mechanism in fluid communication with each of the supplies of supplemental fluid, and in fluid communication with the device requiring the supplemental fluid; and a controller for selectively fluidically coupling at least one of the supplies of supplemental fluid to the device requiring the supplemental fluid through the valve mechanism.

7. The system of claim 6, wherein the system is a printer and the primary fluid containers are ink containers.

8. The system of claim 7, wherein the supplemental fluid comprises a fixer chemical and the device requiring a supplemental fluid is a fixer applicator.

9. The system of claim 6, wherein the controller further identifies which of the replaceable primary fluid containers has the shortest remaining usable lifetime, and selectively causes supplemental fluid to be drawn from the identified container.

10. The system of claim 6, wherein the controller further determines the proportion of remaining supplemental fluid to remaining primary fluid within each container, and selectively draws supplemental fluid from the container having the highest proportion.

11. The system of claim 6, wherein each of the replaceable primary fluid containers includes an electronic memory device electronically accessible by the controller.

12. The system of claim 11, wherein the electronic memory devices include information for determining the remaining quantity of primary and secondary fluids within each container.

13. The system of claim 6, wherein the valve mechanism comprises valves integral with each of the replaceable primary fluid containers having a supply of the supplemental fluid.

14. A system having a plurality of replaceable primary fluid containers and a device to utilize a supplemental fluid, apparatus for supplying the supplemental fluid, comprising:

within at least two of the replaceable primary fluid containers, a supply of the supplemental fluid;

valve means in fluid communication with each of the supplies of supplemental fluid, the valve mechanism having an output in fluid communication with the device to utilize the supplemental fluid; and controller means for selectively fluidically coupling at least one of the supplies of supplemental fluid to the device requiring the supplemental fluid through the valve means.

15. A printer system having a plurality of replaceable primary ink containers and a device to utilize a supplemental fluid, apparatus for supplying the supplemental fluid, comprising:

within at least two of the replaceable primary ink containers, a supply of the supplemental fluid;

a valve mechanism in fluid communication with each of the supplies of supplemental fluid, the valve mechanism having an output in fluid communication with the device to utilize the supplemental fluid; and a controller for selectively fluidically coupling at least one of the supplies of supplemental fluid to the device requiring the supplemental fluid through the valve mechanism.

16. The printer system of claim 15, wherein the supplemental fluid comprises a fixer chemical and the device requiring a supplemental fluid is a fixer applicator.

17. The printer system of claim 15, wherein each of the replaceable primary fluid containers includes an electronic memory device electronically accessible by the controller.

18. The system of claim 17, wherein the electronic memory devices include information for determining the remaining quantity of primary and secondary fluids within each container.

19. The system of claim 15, wherein the valve mechanism comprises valves integral with each of the replaceable primary fluid containers having a supply of the supplemental fluid.

20. A system having a plurality of replaceable primary fluid containers with limited lifetimes and a device utilizing a supplemental fluid, a method of supplying the supplemental fluid, comprising:

provisioning within at least two of the primary fluid containers a supply of the supplemental fluid;

determining which of the primary fluid containers having a supply of the supplemental fluid has the shortest remaining usable lifetime;

drawing supplemental fluid from the supply with the shortest remaining usable lifetime.

21. The method of claim 20, wherein the system is a printer system and the replaceable primary fluid containers are ink containers.

22. The method of claim 21, wherein the supplemental fluid is a fixer fluid.

23. The method of claim 20, wherein each of the replaceable primary fluid containers includes an electronic memory device.

24. The system of claim 23, wherein the electronic memory devices include information for determining the remaining quantity of primary and secondary fluids within each container.

25. A system having a plurality of replaceable primary fluid containers with limited lifetimes and a device utilizing a supplemental fluid, a method of supplying the supplemental fluid, comprising:

provisioning within at least two of the primary fluid containers a supply of the supplemental fluid;

determining for each of the primary fluid containers having a supply of the supplemental fluid the proportion of the remaining supplemental fluid to the remaining primary fluid;

drawing supplemental fluid from the supply with the highest proportion of remaining supplemental fluid to remaining primary fluid.

26. The method of claim 25, wherein the system is a printer system and the replaceable primary fluid containers are ink containers.

27. The method of claim 26, wherein the supplemental fluid is a fixer fluid.

28. The system of claim 25, wherein each of the replaceable primary fluid containers includes an electronic memory device.

29. The system of claim 28, wherein the electronic memory devices include information for determining the remaining quantity of primary and secondary fluids within each container.

* * * * *

UNITED STATES PATENT AND TRADEMARK OFFICE

CERTIFICATE OF CORRECTION

PATENT NO. : 6,536,886 B1
DATED : March 25, 2003
INVENTOR(S) : Mott

It is certified that error appears in the above-identified patent and that said Letters Patent is hereby corrected as shown below:

Column 5,
Lines 21 and 45, delete “A”, and insert therefor -- In a --.

Column 6,
Lines 17, 30 and 59, delete “A”, and insert therefor -- In a --.

Column 7,
Line 15, delete “A”, and insert therefor -- In a --.

Signed and Sealed this

Thirtieth Day of December, 2003

JAMES E. ROGAN
*Director of the United States Patent and Trademark Office*